US007247046B1

(12) United States Patent
Wu

(10) Patent No.: US 7,247,046 B1
(45) Date of Patent: Jul. 24, 2007

(54) CONNECTOR ASSEMBLY HAVING STATUS INDATOR MEANS

(75) Inventor: Jerry Wu, Irvine, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/481,267

(22) Filed: Jul. 3, 2006

(51) Int. Cl.
*H01R 3/00* (2006.01)

(52) U.S. Cl. ..... 439/490; 439/668

(58) Field of Classification Search ..... 439/490, 439/668

See application file for complete search history.

(56) References Cited

U.S. PATENT DOCUMENTS 4,386,818 A * 6/1983 Millhimes et al. ..... 439/490
5,364,292 A 11/1994 Bethurum
5,667,407 A 9/1997 Frommer et al.
6,259,170 B1 * 7/2001 Limoge et al. ..... 307/10.8
6,457,992 B2 * 10/2002 Posey et al. ..... 439/490
6,485,338 B1 * 11/2002 Wu ..... 439/862
6,663,415 B1 12/2003 Wu
6,705,901 B1 * 3/2004 Lin ..... 439/668
6,733,333 B1 5/2004 Chen

* cited by examiner

*Primary Examiner*—Truc Nguyen
(74) *Attorney, Agent, or Firm*—Wei Te Chung

(57) ABSTRACT

A power connector assembly (100) includes a housing (2) defining a number of passages (23, 24), a circuit board (4) assembled to the housing and including a pair of LEDs (42) capable of being actuated to emit light, a number of contacts respectively received in the passages of the housing, a cable (6) electrically connecting with the circuit board, a rear cover (7) assembled to the housing to enclose the contact, the circuit board and front end of the cable, and status indicator means (81, 82) aligning with the LED of the circuit board and enclosed by the rear cover to spread the light emitted from the LED outwardly for indicating normal status between the power connector assembly and a complementary connector. The contacts include a power contact (31), a ground contact (32) electrically connecting with the circuit board and a detect contact (33) electrically connecting with the LED of the circuit board.

15 Claims, 23 Drawing Sheets

CONNECTOR ASSEMBLY HAVING STATUS INDATOR MEANS

BACKGROUND OF THE INVENTION

1. Field of the Invention

The present invention generally relates to a connector assembly, and more particularly to a connector assembly used for power transmission.

2. Description of Related Art

For indicating the normal status between a pair of complementary connectors, such as a cable connector assembly and a header connector mounted on a printed circuit board, the cable connector assembly is often equipped with LED elements. U.S. Pat. No. 6,733,333 ('333 patent) discloses a transmission cable having a cable and two connectors at the ends of the cable. Each connector includes an integrated circuit and a LED in the transparent plastic housing thereof. The integrated circuit drives the LED to emit light after installation of the transmission cable, and drives the LED to flash upon transmission of signal/data through the cable. The LED is off when the transmission cable failed. However, '333 patent needs to make the transparent plastic housing wholly in transparent material, which is costly in manufacture cost. Therefore, new design is needed to address above problems.

BRIEF SUMMARY OF THE INVENTION

Accordingly, an object of the present invention is to provide a connector assembly with status indicator means for properly indicating normal status of the connector assembly and a complementary connector.

In order to achieve the above-mentioned object, a connector assembly in accordance with the present invention comprises a housing assembled with a plurality of contacts, a circuit board assembled to the housing and comprising an LED, a cable electrically connecting with the circuit board, a rear cover assembled to the housing to enclose the contacts, the circuit board and front end of the cable, and status indicator means aligning with the LED of the circuit board and enclosed by the rear cover to spread the light emitted from the LED outwardly for indicating normal status between the power connector assembly and a complementary connector.

Other objects, advantages and novel features of the invention will become more apparent from the following detailed description of the present embodiment when taken in conjunction with the accompanying drawings.

DETAILED DESCRIPTION OF THE INVENTION

Figure 1:
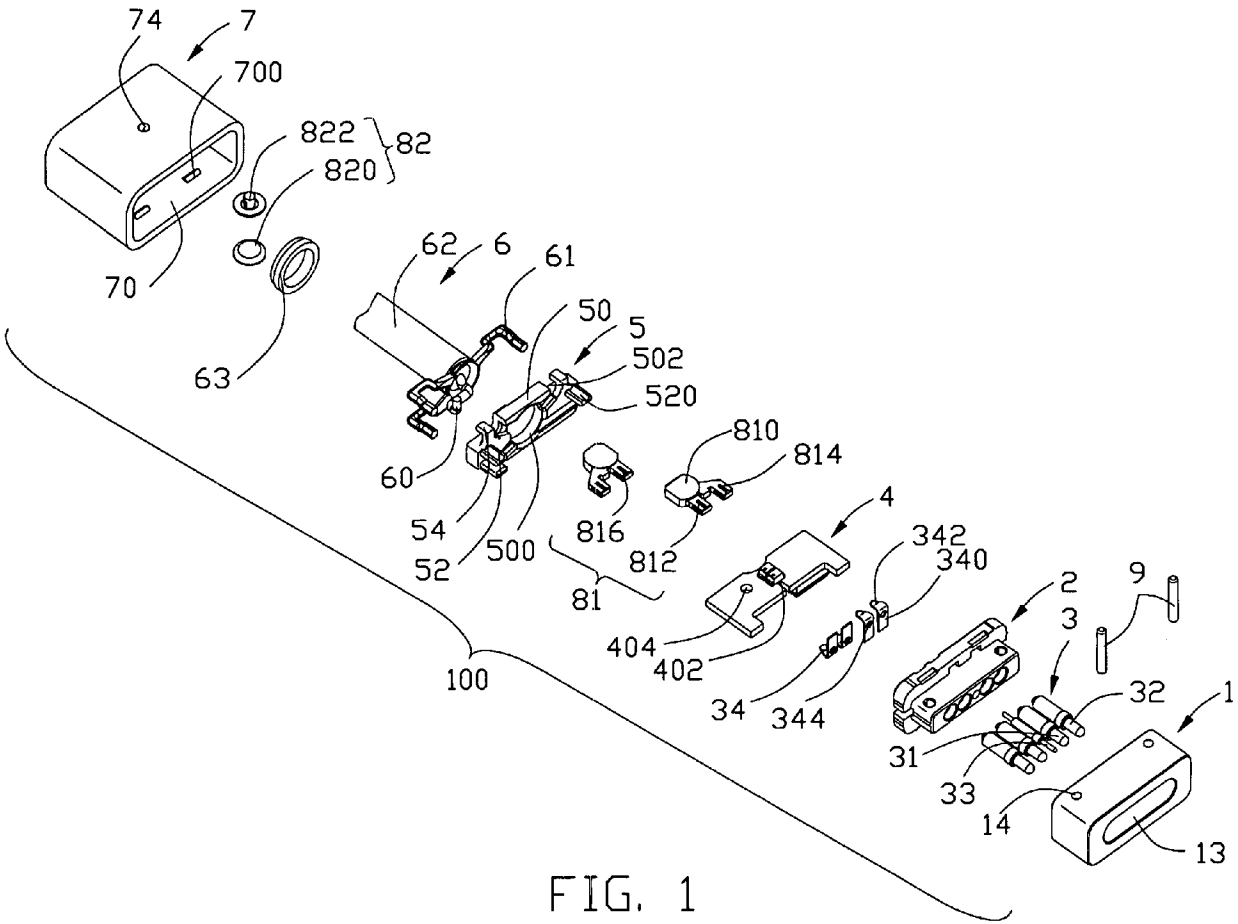
FIG. 1 is an exploded, perspective view of a connector assembly in accordance with the first embodiment of the present invention.

Reference will now be made to the drawing figures to describe the present invention in detail.

Figure 2:
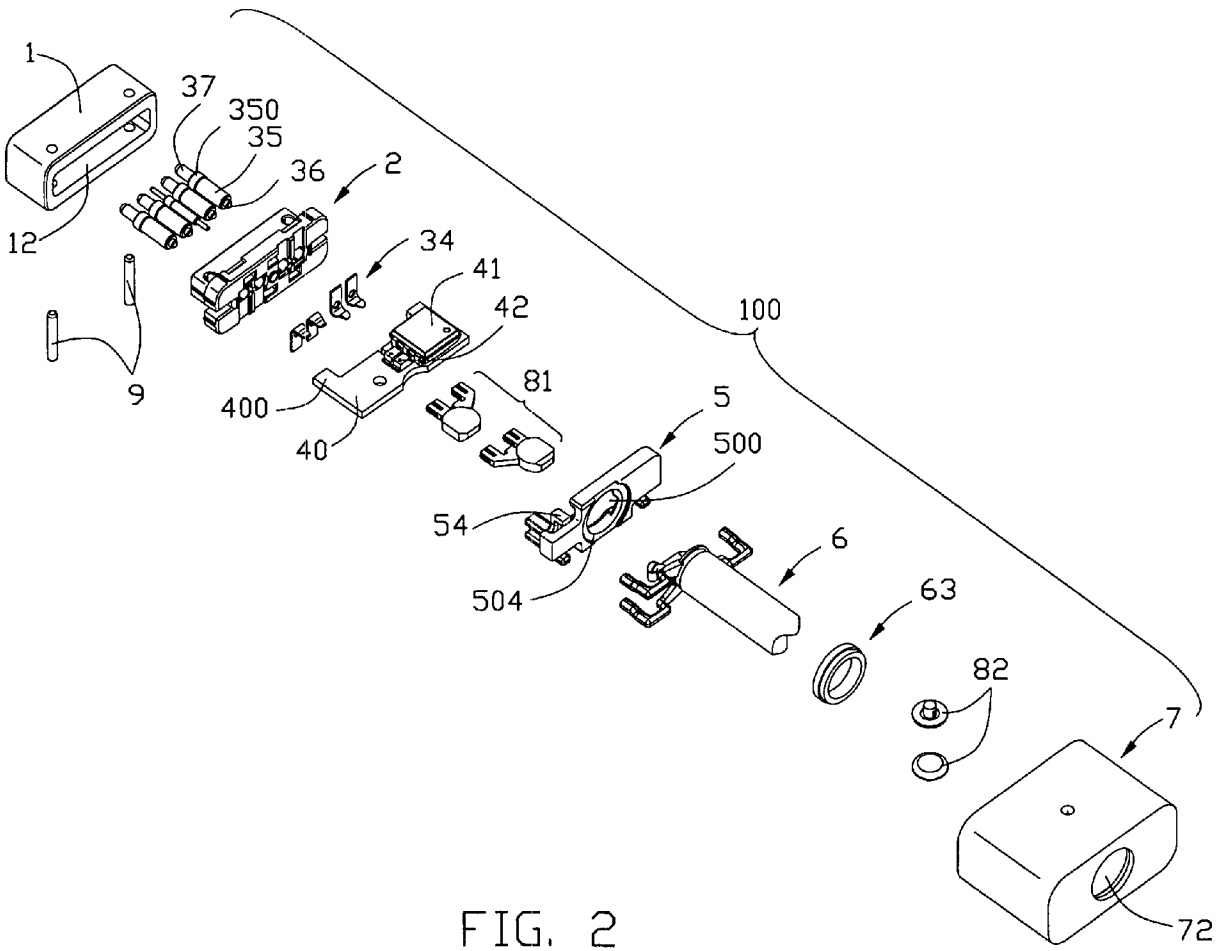
FIG. 2 is a view similar to FIG. 1, but viewed from a different aspect.
Figure 3:
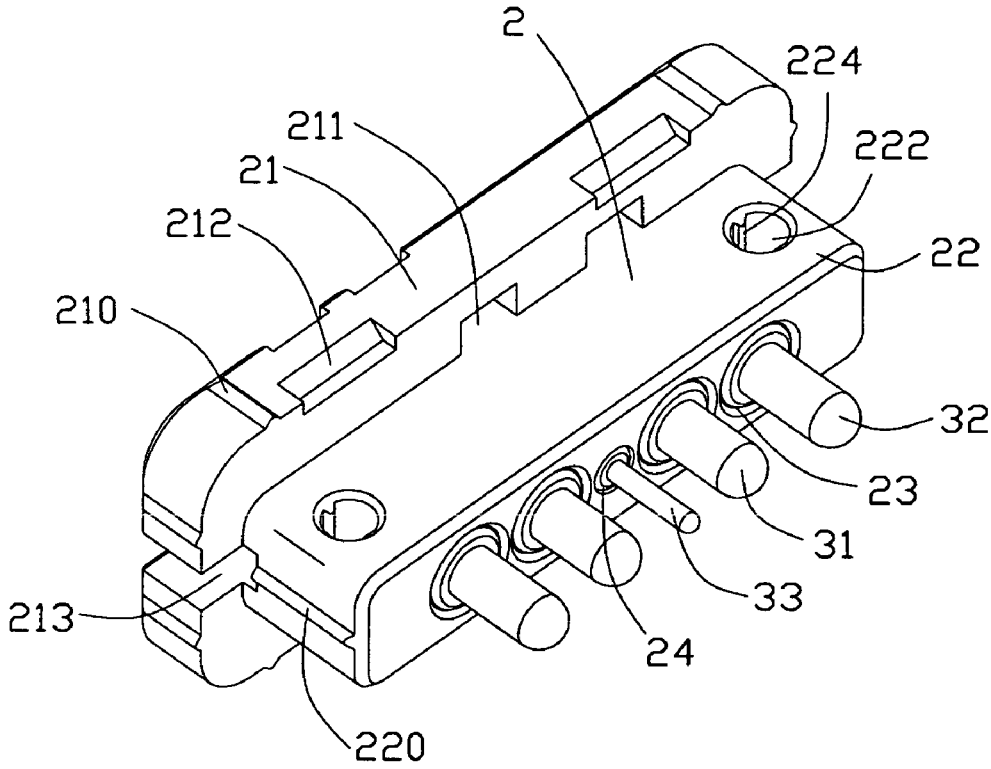
FIG. 3 is a partially assembled view of the connector assembly of FIG. 1.

Referring to FIGS. 1-3, a connector assembly 100 in accordance with the first embodiment of the present invention comprises a housing 2, a plurality of conductive contacts 3 assembled to the housing 2, a circuit board 4 assembled to the housing 2, a plurality of conductive elements 34 respectively electrically connecting with the contacts 3 and the circuit board 4, a strain relief member 5 assembled to and electrically connecting with the circuit board 4, a cable 6 electrically connecting with the strain relief member 5 to achieve the electrical connection with the circuit board 4, front and rear covers 1, 7 respectively assembled to the housing 2 and together enclosing the elements mentioned above therebetween.

Figure 4:
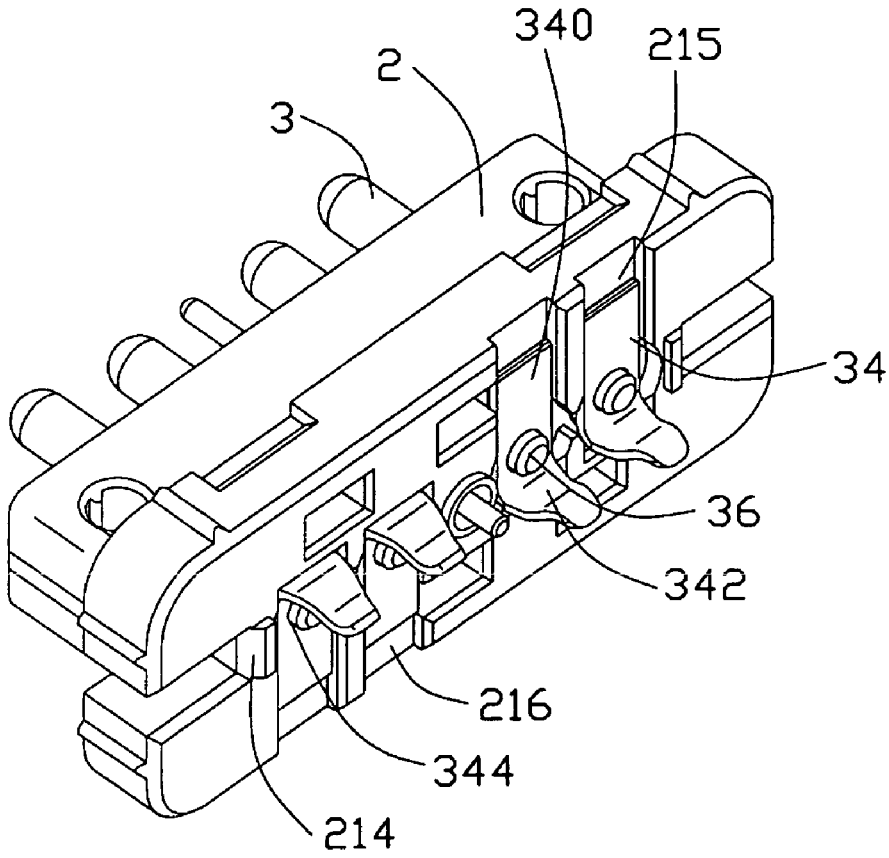
FIG. 4 is a view similar to FIG. 3, but viewed from a different aspect.

Please refer to FIGS. 3-4, the housing 2 comprises a base portion 21 and a tongue portion 22 extending forwardly from the base portion 21. The housing 2 defines two pairs of large-size first receiving passages 23 and a center small-size second passage 24 respectively recessed from a front face of the tongue portion 22 to a rear face of the base portion 21. Each passage 23, 24 is formed with a relatively larger dimension in a front portion thereof and a relatively smaller dimension in remaining portion thereof. The base portion 21 forms a plurality of first friction ribs 210 arranged on outer periphery of the base portion 21 with an interval and extending along a front-to-back direction. A pair of cutouts 212 are respectively spaced arranged at joints of upper, lower surfaces and a front face of the base portion 21 with a tapered surface. The base portion 21 defines two pairs of rectangular first slots 211 spaced arranged in upper and lower walls and respectively recessed from the front face to the rear face thereof with determined distance from respective top and bottom surfaces. The base portion 21 also defines a pair of second slots 213 extending along the front-to-back direction to communicate the front face with opposite rear face and recessed inwardly from opposite lateral walls thereof. A pair of tapered protrusions 214 are formed on the rear face of the base portion 21 and locate adjacent to corresponding second slots 213 for facilitating the insertion of the circuit board 4. A pair of first rectangular recesses 215 and a pair of second rectangular recesses 216 with opening toward opposite contrary directions respectively recessed forwardly from the rear face of the base portion 21 and respectively communicating with the first receiving passages 23. The tongue portion 22 defines a pair of circular first engaging holes 222 extending therethrough along up-to-down direction and forms a pair of second friction ribs 220 on opposite lateral walls thereof extending along the front-to-back direction. Each engaging hole 222 forms a pair of ribs 224 protruding outwardly from inner periphery thereof.

Now referring to FIGS. 1-4, the conductive contacts 3 consist of a pair of ground contacts 32, a pair of power contacts 31 located between the pair of ground contacts 32 and a center detect contact 33 located between the pair of power contacts 31. Each contact 3 is of a POGO Pin type, that is to say, there is a spring (not shown) inside the contact 3, thus, when mating, the contact 3 can be pressed to rearward move along the mating direction. Each ground contact 32 comprises a column-shape contacting portion 37 with a relatively small diameter, a column-shape media portion 35 with a relatively large diameter, and an end portion 36 formed at rear end of the media portion 35 with a column-shape and smaller diameter. A front engaging section 350 protrudes outwardly from outer periphery of the media portion 35. The power contact 32 has the same structure as that of the ground contact 31 except the contacting portion 37 thereof has a length shorter than that of the ground contact 31. The detect contact 33 has the same structure as that of the power contact 32 except each portion thereof has a smaller diameter than that of the power contact 32. In addition, the end portion 36 of the detect contact 33 is longer than that of the power or ground contacts 31, 32.

Referring to FIGS. 1-2 and 4, the conductive elements 34 are divided into two groups respectively oriented in opposite directions. Each conductive element 34 is of L-shape and comprises an upright connecting portion 340 defining a circular receiving opening 344 therein, and a curved tail portion 342 substantially vertically extending from the connecting portion 340.

Referring to FIGS. 1-2, the circuit board 4 comprises a substrate 40 formed with first conductive pads and opposite second conductive pads (not shown), and a pair of LEDs 42 arranged on opposite sides of the substrate 40. The circuit board 4 may be equipped with an IC 41 for driving the LEDs 42 to emit light. The substrate 40 comprises a pair of stretching arms 400 extending forwardly from opposite lateral sides thereof and defines a wire-receiving hole 404 in a rear portion thereof.

The strain relief member 5 is die casted from metal material or other conductive material. The strain relief member 5 comprises a main portion 50 defining a circular through hole 500 in a center thereof. Three corners of the main portion 50 are cutout to form three L-shape cutout areas 502. Three jointing portions 52 respectively forwardly extending from a front surface of the main portion 50 and respectively located adjacent to both corresponding cutout area 502 and corresponding lateral side of the main portion 50. Three substantially L-shape routing portions 54 firstly vertically extending from bottoms of corresponding cutout areas 502, then flatly extending into the three cutout areas 502. In the vertical direction, each routing portion 54 does not align with corresponding jointing portion 52. Each jointing portion 52 is partially cut to form a curved recess area 520 mainly extending in the front-to-back direction. A substantially circular receiving opening 504 recesses forwardly from a rear surface of the main portion 50 to communicate with the through hole 500 with a larger diameter than that of the through hole 500.

The cable 6 comprises an inner conductor 60, a metal braiding layer 61 surrounding the inner conductor 60, and an outer jacket 62 enclosing the metal braiding layer 61. A front portion of the outer jacket 62 is stripped to expose part of the inner conductor 60 and the metal braiding layer 61. In this embodiment, the exposed portion of the metal braiding layer 61 is divided into three parts corresponding to the routing portions 54 and the jointing portions 52 of the strain relief member 5. The cable 6 may be equipped with a stepped-shape stuffing member 63 made from resin material.

Figure 11:
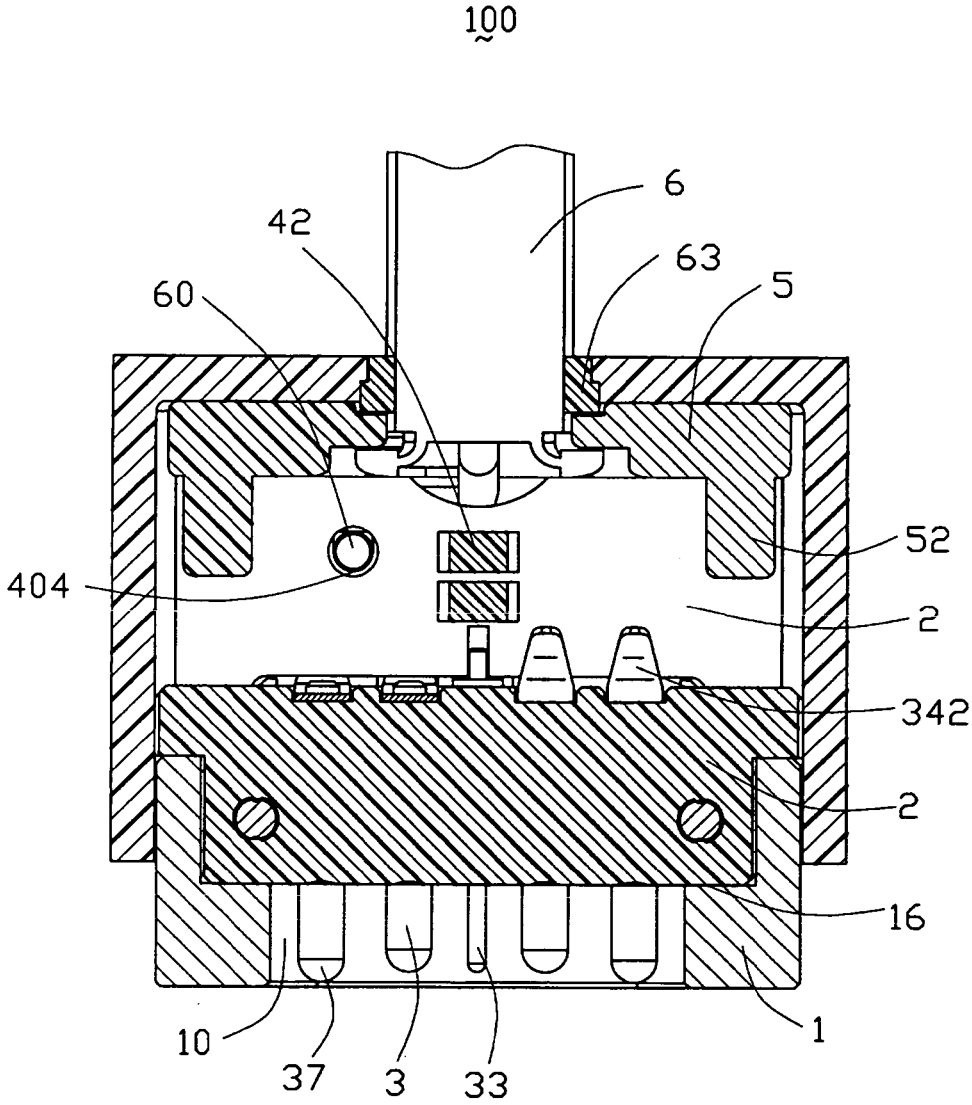
Figure 12:
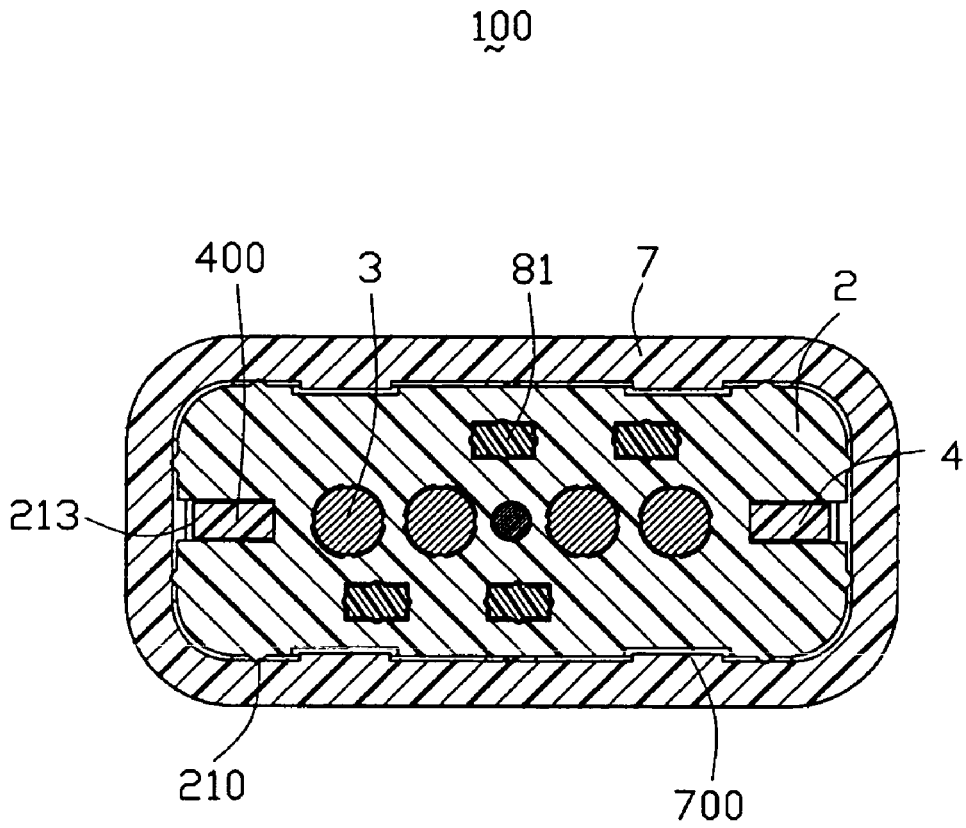

The front and rear covers 1, 7 are respectively assembled to the housing 2. The front cover 1 is made from conductive material and defines an elliptical-shape front receiving cavity 10 recessed rearwardly from a front surface thereof for receiving complementary connector and a rectangular rear receiving passage 12 recessed forwardly from a rear surface thereof to communicate with the front receiving cavity 10 for receiving the housing 2. The receiving passage 12 has a large size along a lateral direction of the front cover 1 than that of the receiving cavity 10, thus, forming a pair of step portions 16 therebetween (FIG. 11). The front cover 1 also defines a pair of circular second engaging holes 14 respectively recessed from a top surface to opposite rear surface thereof and locating adjacent to the rear surface thereof. The rear cover 7 is made from resin material and of rectangular shape. The rear cover 7 defines a rectangular receiving space 70 recessed rearwardly from a front surface thereof and a rear stepped receiving passage 72 communicating with the receiving space 70 for permitting the protruding of the cable 6 and receiving the stuffing member 63. The rear cover 7 forms two pairs of protrusions 700 on opposite inner upper wall and opposite lower wall thereof and a pair of circular receiving holes 74 extending through top and bottom surfaces thereof.

The cable connector assembly 100 also comprises status indicator means (not labeled) made of transparent material or semitransparent material and consisting of a pair of first light pipes 81 overlapping the pair of LEDs 42 for spreading the light emitted by the LEDs 42 outwardly, and a pair of second light pipes 82 aligned with corresponding first light pipes 81 in a vertical direction and assembled to the rear cover 7 to spread the light permeated by the first light pipes 81 outwardly for indicating the normal status of the cable connector assembly 100. Each first light pipe 81 comprises a first body section 810 and a pair of first and second engaging sections 812, 814 respectively extending forwardly and sideward then forwardly from the first body section 810, thus, the pair of first and second engaging sections 812, 814 are spaced arranged along the lateral direction. In addition, each engaging section 812, 814 forms a pair of ribs 816 on opposite upper and lower surfaces thereof. The second light pipe 82 comprises a second body section 820 and a post-shape positioning section 822 extending outwardly from a center of the second body section 820. In assembly, the pair of first light pipes 81 and the pair of second light pipes 82 are respectively arranged in image relationship relative to each other.

Figure 10:
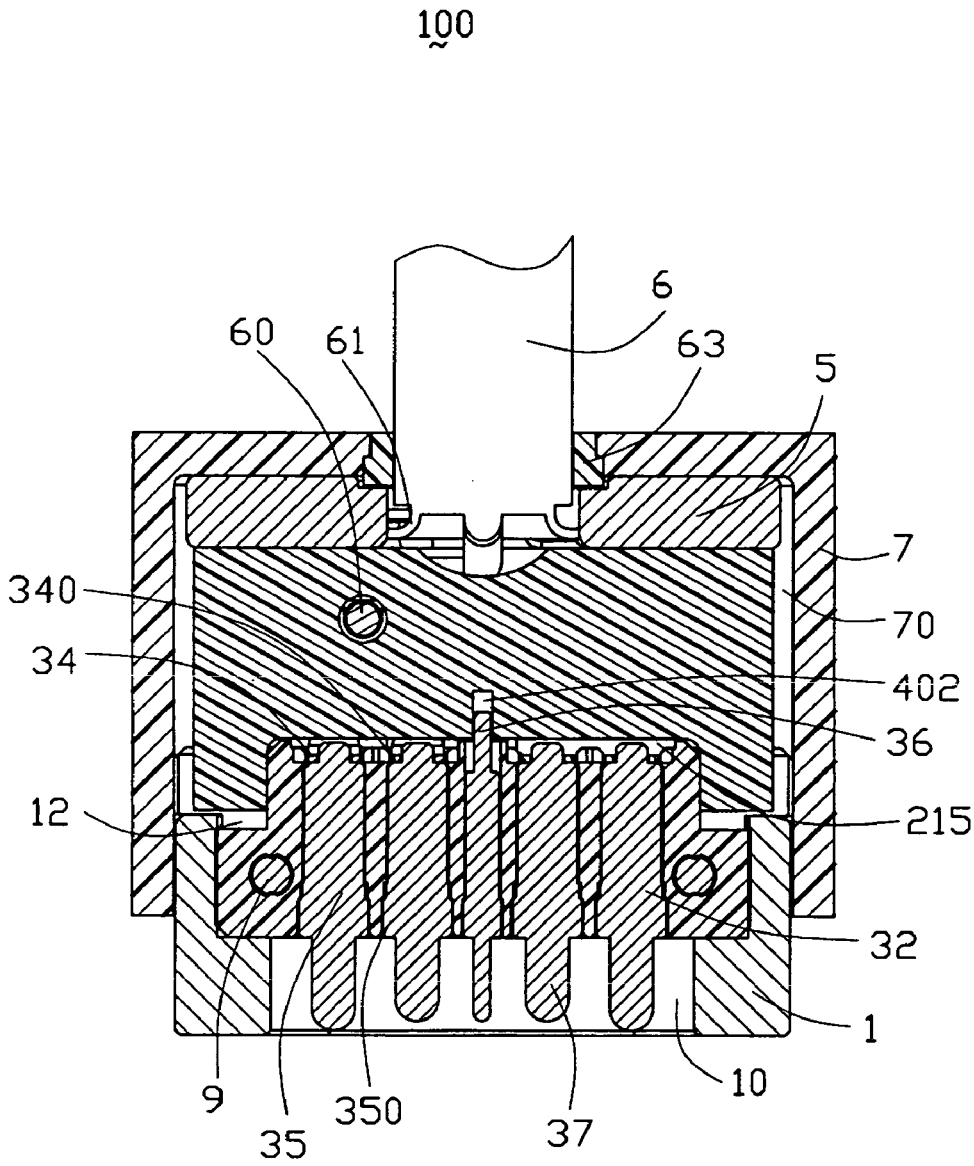

Referring to FIGS. 3-6 in conjunction with FIGS. 10-11, in assembly, the conductive contacts 3 are assembled to the housing 2 with the media portions 35 of the power contacts 31, ground contacts 32 and the detect contact 33 respectively received in corresponding first and second receiving passages 23, 24, the contacting portions 37 exposed beyond the front surface of the housing 2. The end portions 36 of the power and ground contacts 31, 32 are respectively received in the first and second recesses 215, 216 and extend no longer than the rear surface of the housing 2, while, the end portion 36 of the detect contact 33 extends beyond the rear surface of the housing 2. The conductive elements 34 are respectively assembled to the housing 2 and the power and ground contacts 31, 32 with the connecting portions 340 received in corresponding first and second recesses 215, 216 of the housing 2 and corresponding end portions 36 of the power and ground contacts 31, 32 protruding through the receiving openings 344 and soldered with the connecting portions 340. Thus, the conductive elements 34 form electrical connection with corresponding power and ground contacts 31, 32.

Figure 7:
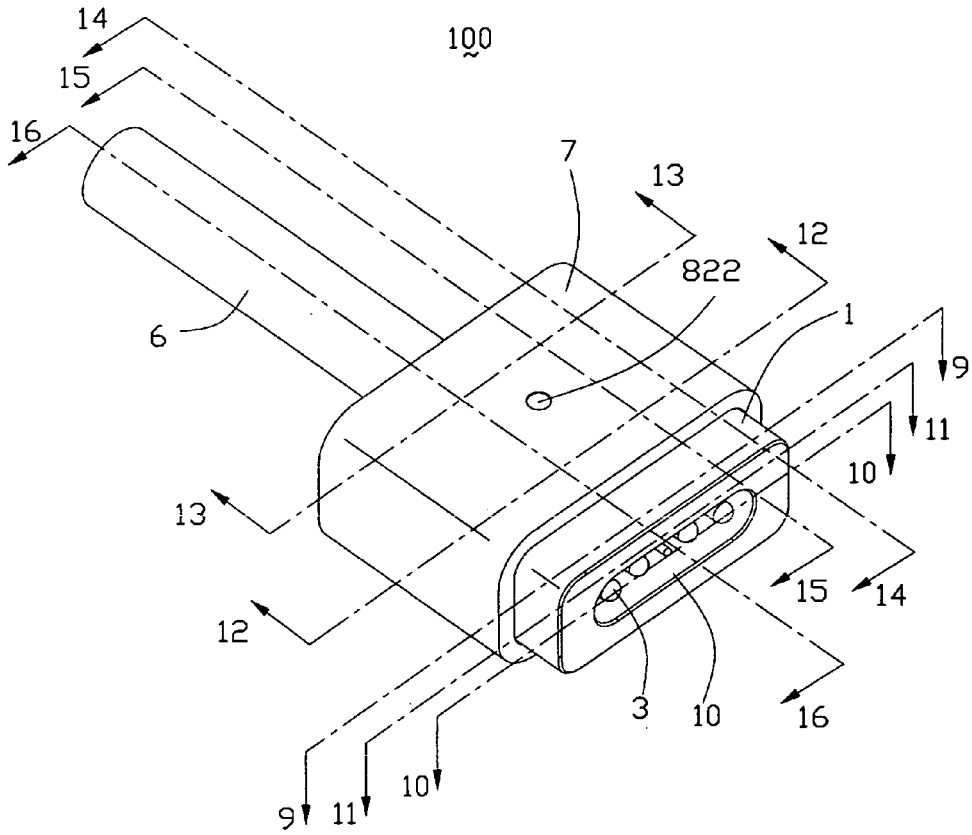
FIG. 7 is an assembled view of the connector assembly of FIG. 1.
Figure 8:
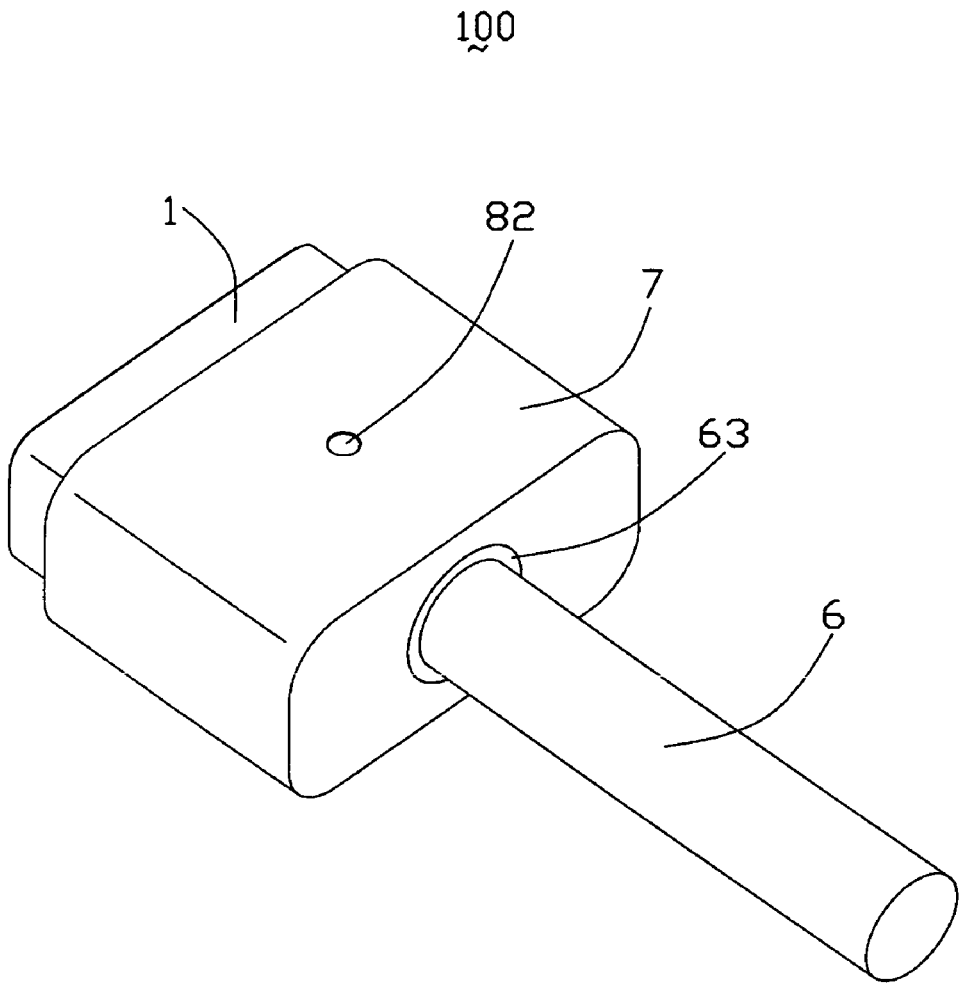
FIG. 8 is a view similar to FIG. 7, but viewed from a different aspect.
Figure 15:
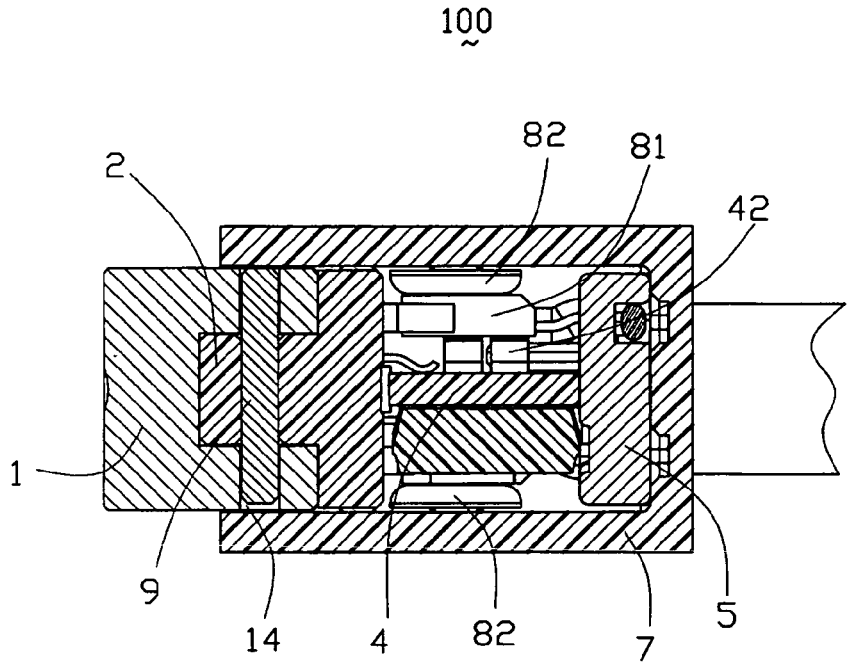
Figure 16:
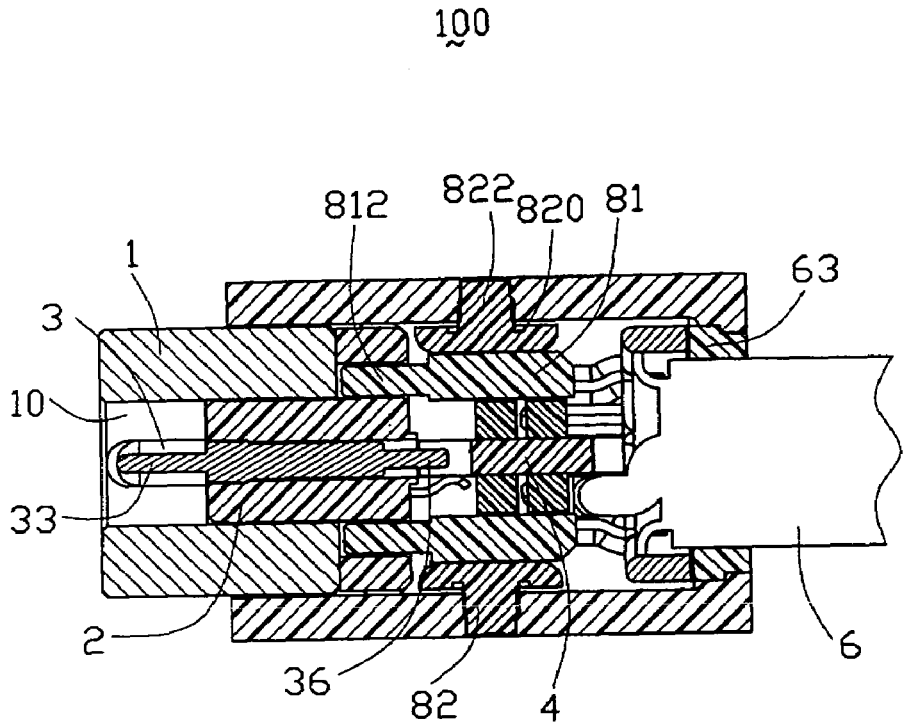
Figure 17:
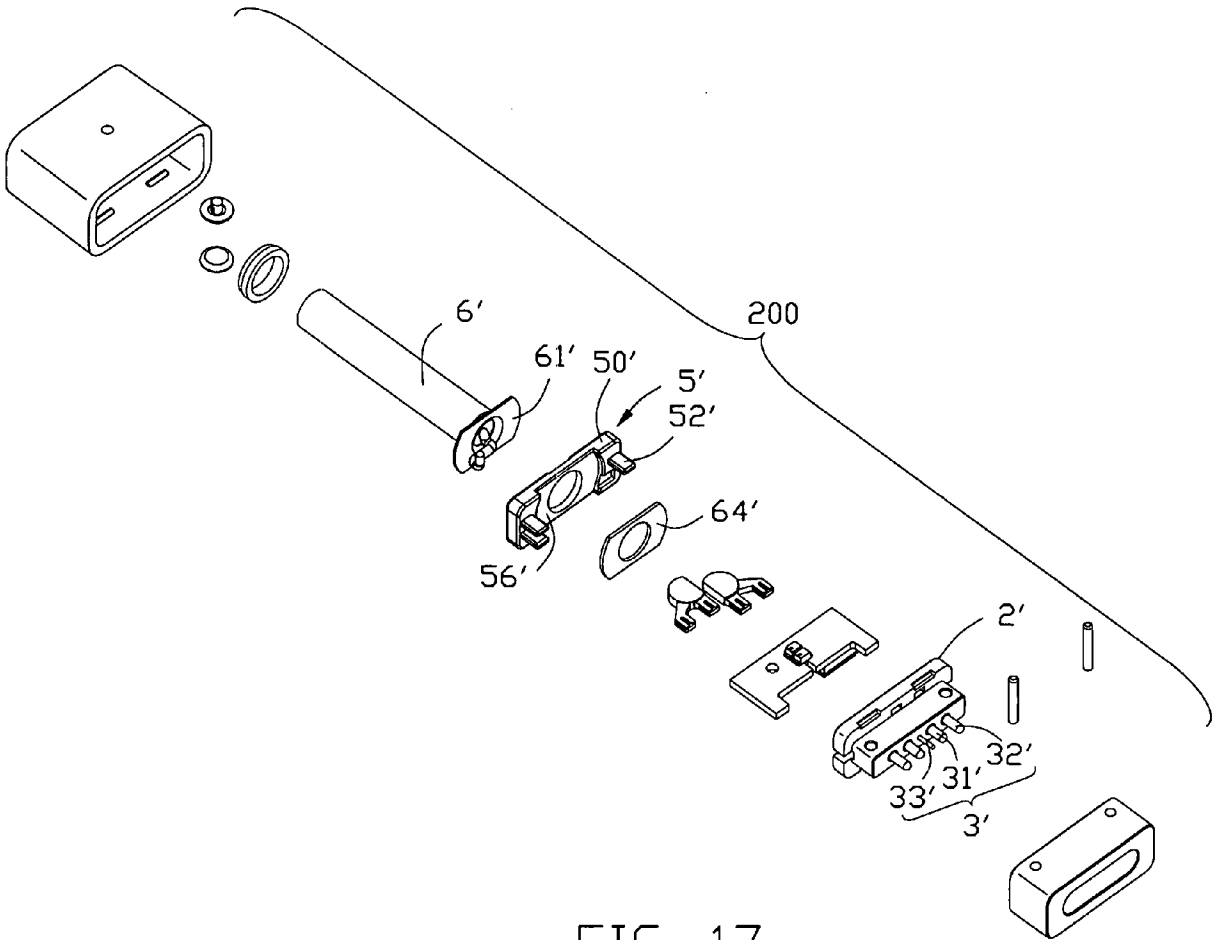
FIG. 17 is an exploded, perspective view of a connector assembly in accordance with the second embodiment of the present invention.
Figure 18:
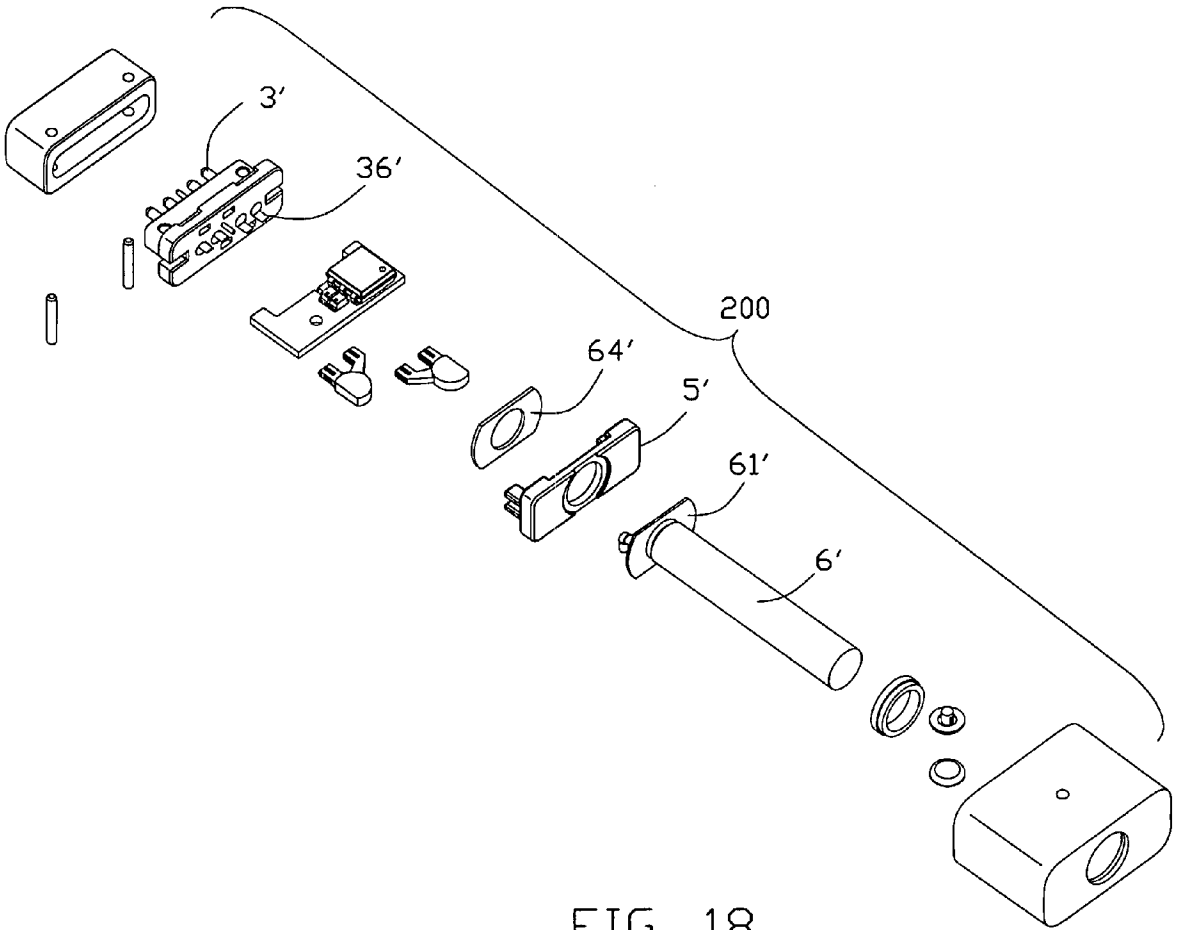
FIG. 18 a view similar to FIG. 17, but viewed from a different aspect.
Figure 19:
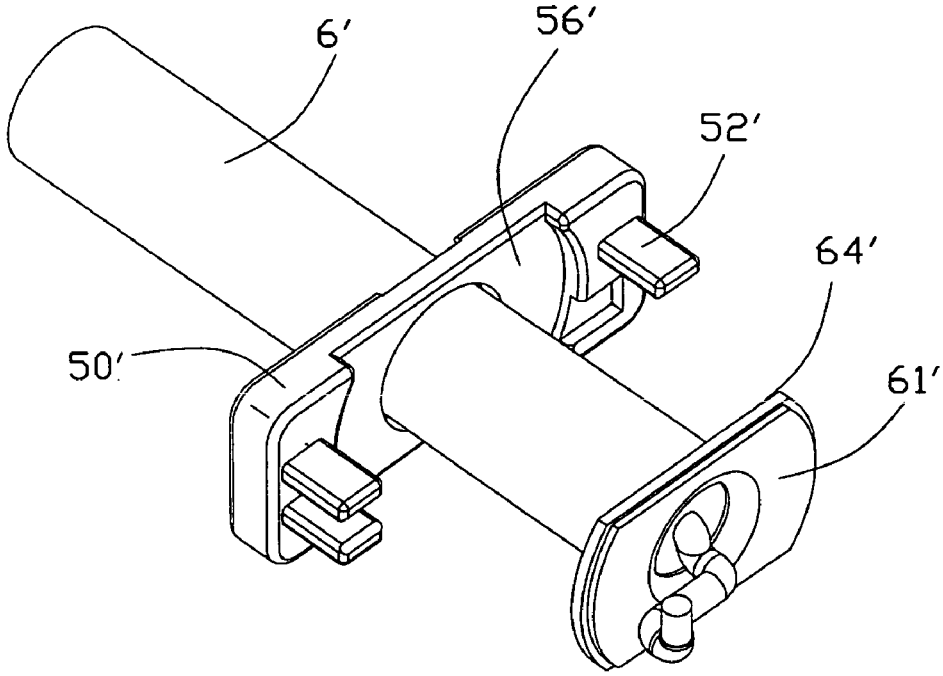
FIG. 19 is a partially assembled view of the connector assembly of the second embodiment.
Figure 20:
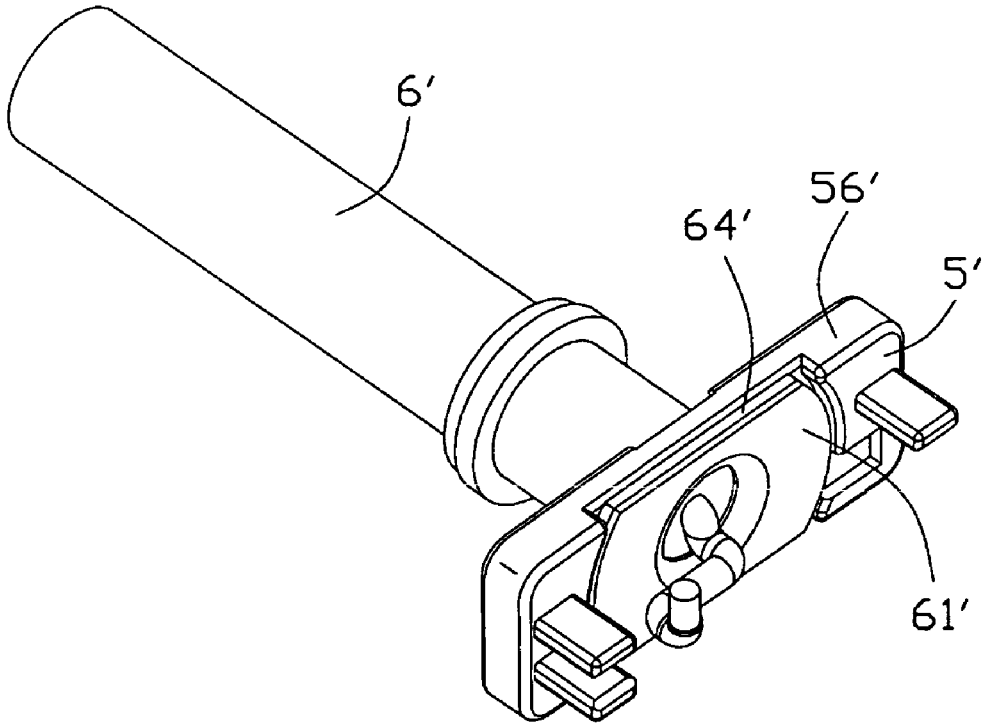
FIG. 20 is an assembled, perspective view of FIG. 19.
Figure 21:
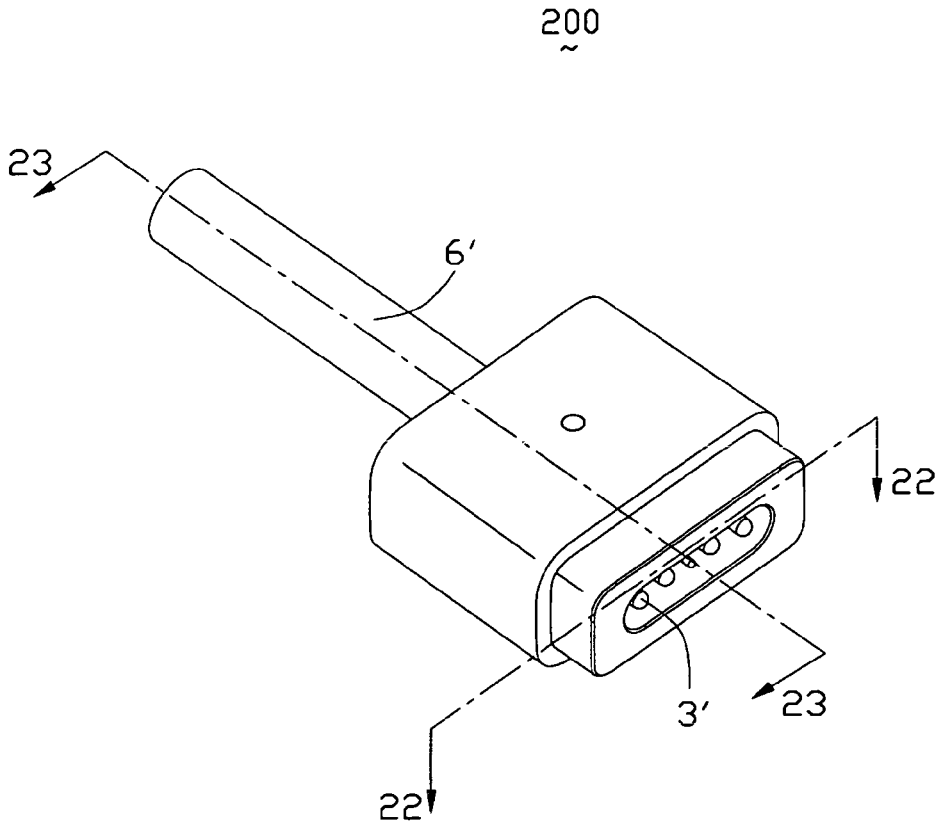
FIG. 21 is an assembled, perspective view of FIG. 17.
Figure 22:
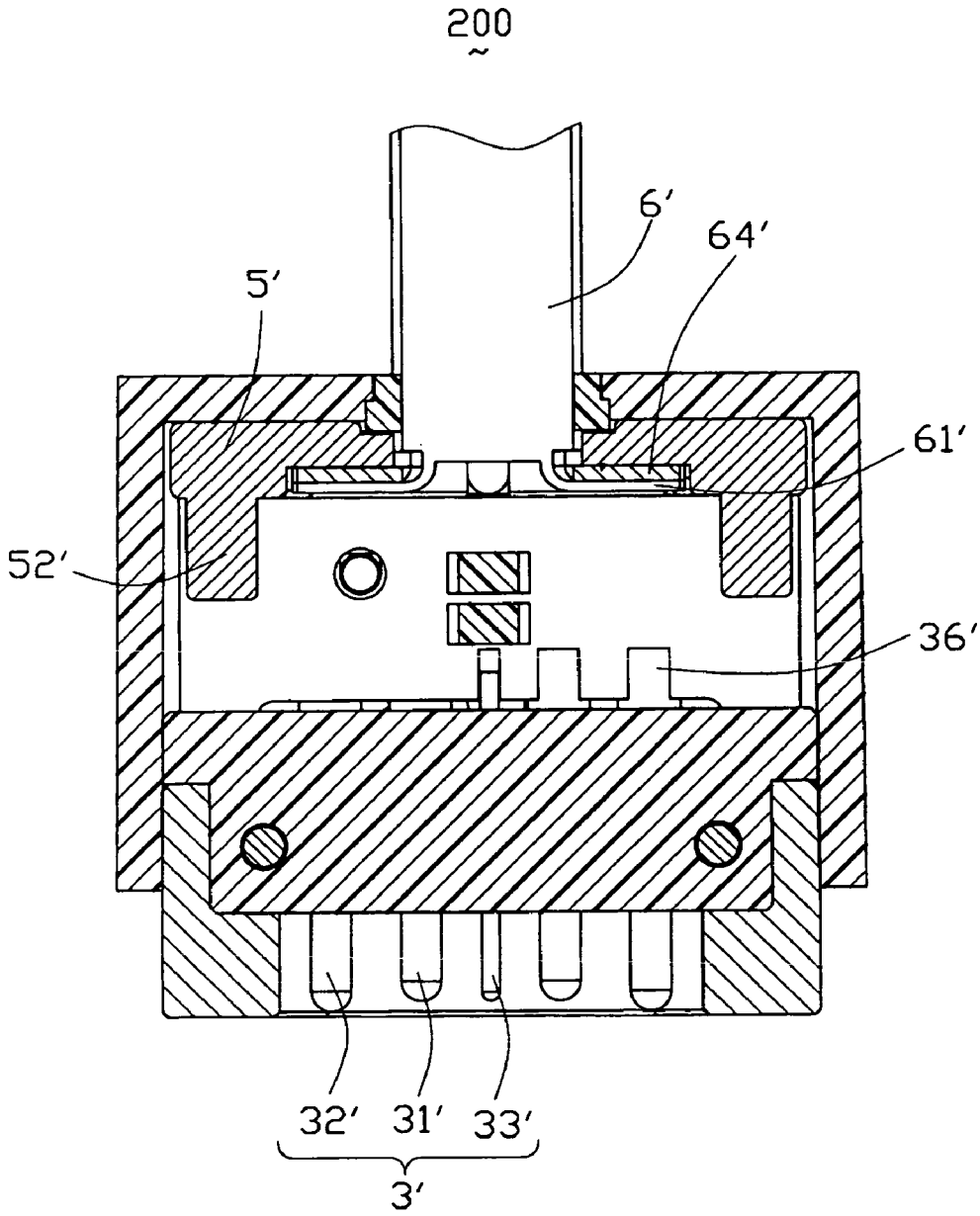
FIGS. 22-23 are cross-section views taken along lines 22-22 to 23-23 of FIG. 21.
Figure 23:
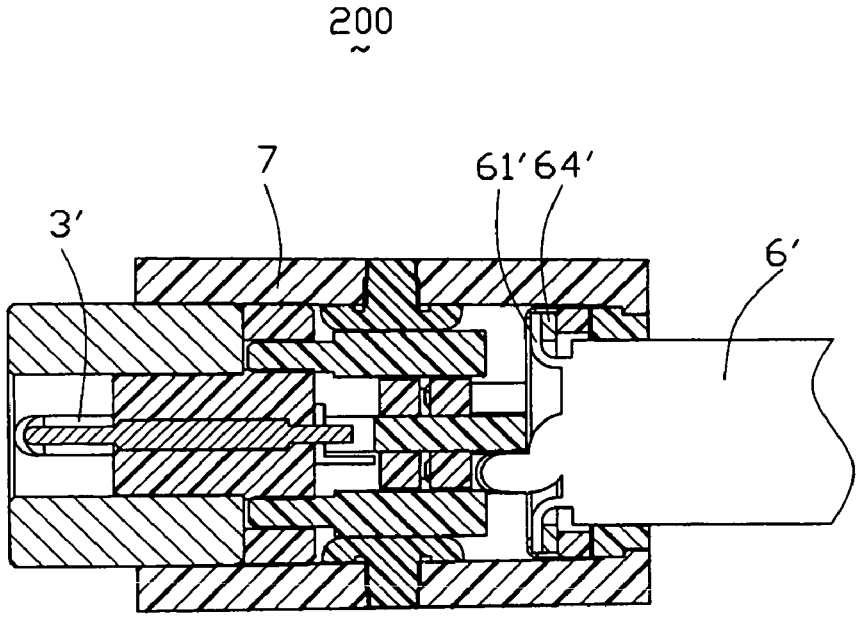

Then referring to FIG. 7 in conjunction with FIGS. 11 and 15, the front cover 1 is assembled to the housing 2 via a pair of pins 9. The tongue portion 22 is firstly inserted into the receiving passage 12 of the front cover 1 until the front surface thereof abuts against the step portions 16 of the front cover 1 and the base portion 21 abuts against a rear surface of the front cover 1. Thus, the tongue portion 22 is frictionally received in the receiving passage 12 of the front cover 1 by means of the pair of second friction ribs 220. Furthermore, the contacting portions 37 are exposed in the receiving cavity 10 with tip ends of the ground contacts 32 substantially coplanar with a front surface of the front cover 1. The pair of first engaging holes 222 respectively align with the pair of second engaging holes 14 of the front cover 1 in the vertical direction, thus, the pair of pins 9 respectively inserts through the second engaging holes 14 and the first engaging holes 222 to position the front cover 1 relative to the housing 2. Of course, the engagement between the front cover 1 and the housing 2 also can be realized by other means, such as using glue, latch means et al.

Figure 5:
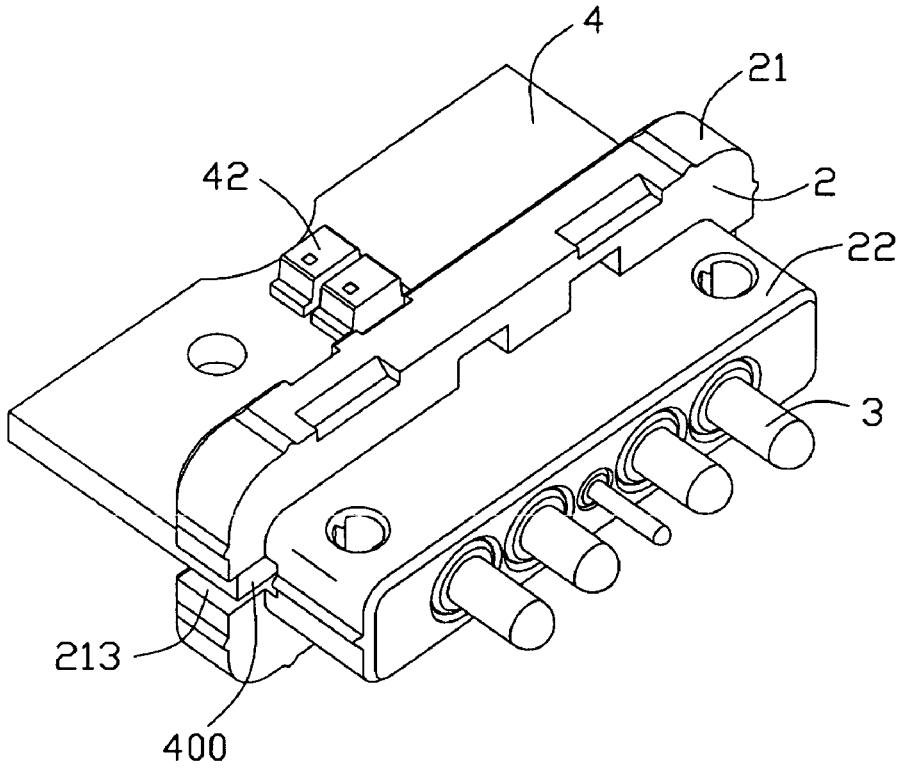
FIGS. 5-6 are partially assembled views of the connector assembly shown in FIG. 1, but viewed from different aspects.
Figure 6:
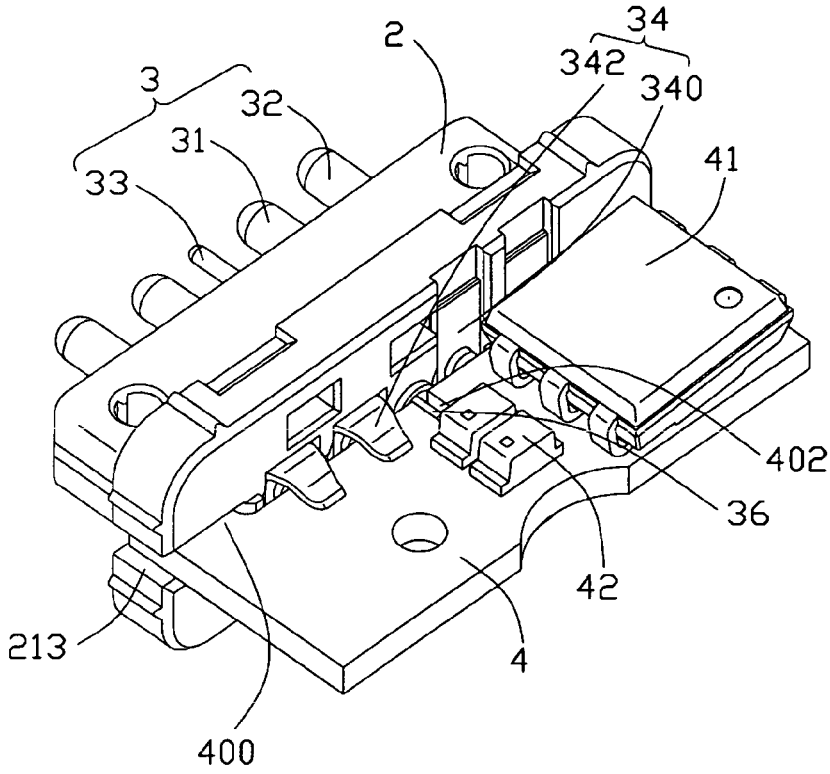

Then, referring to FIGS. 5-6 in conjunction with FIGS. 11 and 14-16, the circuit board 4 is assembled to the housing 2 and electrically connects with the conductive elements 34 and the end portion 36 of the detect contact 33 for forming electrical connection with the contacts 3. The pair of stretching arms 400 are respectively received in the second slots 213 with the guidance of the pair of tapered protrusions 214. The two pairs of opposite oriented curved tail portions 342 are respectively soldered to corresponding traces on opposite upper and lower surfaces of the circuit board 4 to sandwich the circuit board 4 therebetween and form electrical connection with the circuit board 4. The end portion 36 of the detect contact 33 is received in a slit 402 rearward extending from a middle of a front edge of the circuit board 4 to directly electrically connect with the pair of LEDs 42.

Now referring to FIGS. 1-3 in conjunction with FIGS. 9 and 13-15, the pair of first light pipes 81 are respectively assembled to the housing 2 with the pair of first and second engaging sections 812, 814 respectively frictionally received in the first slots 211 of the housing 2 via the ribs 816 formed thereon. Therefore, the first body sections 810 of the first light pipes 81 are respectively locate above corresponding LEDs 42 of the circuit board 4 for spreading the light emitting from the LEDs 42 outwardly.

Figure 9:
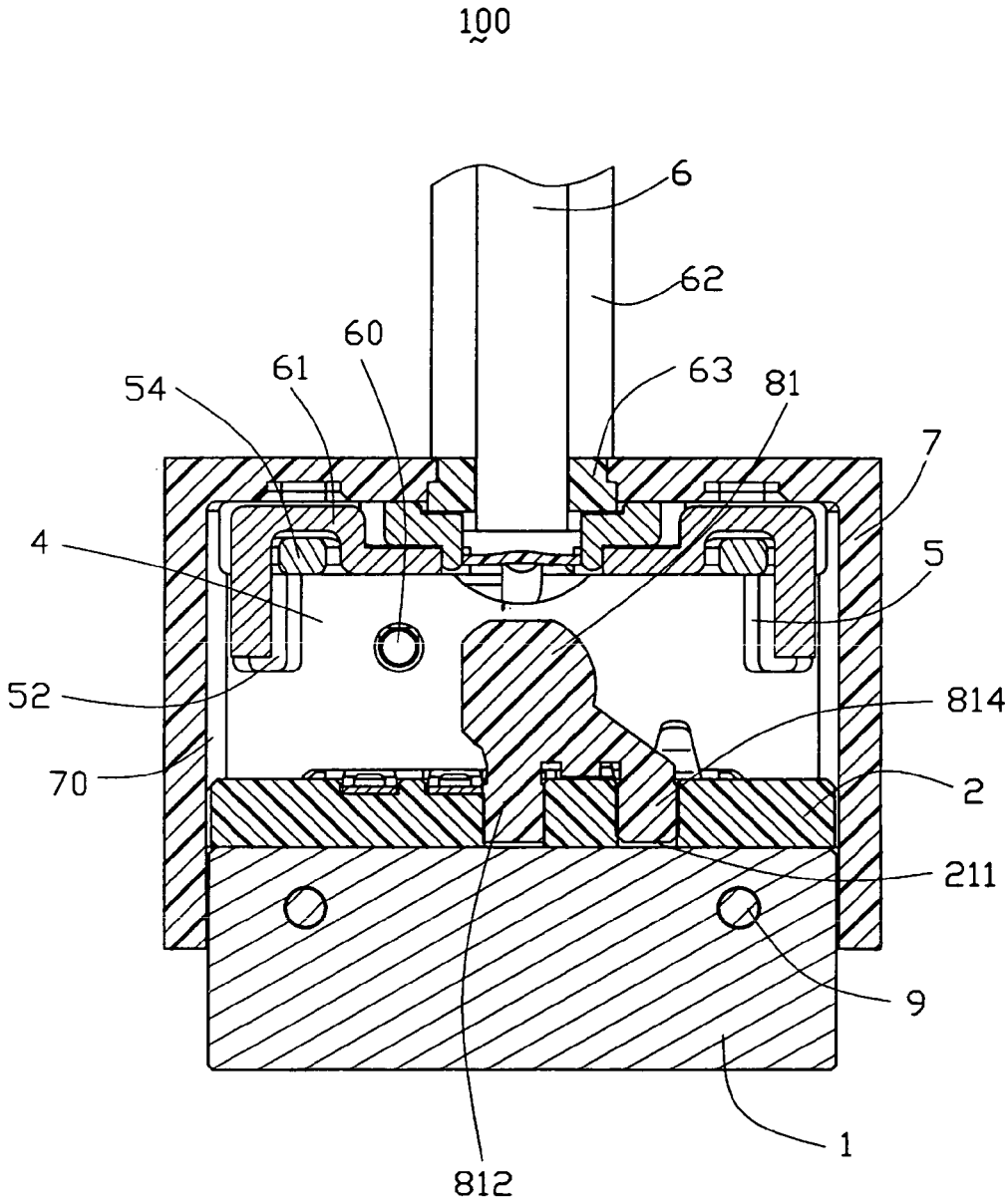
FIGS. 9-16 are cross-section views taken along lines 9-9 to 16-16 of FIGS. 7-8.
Figure 13:
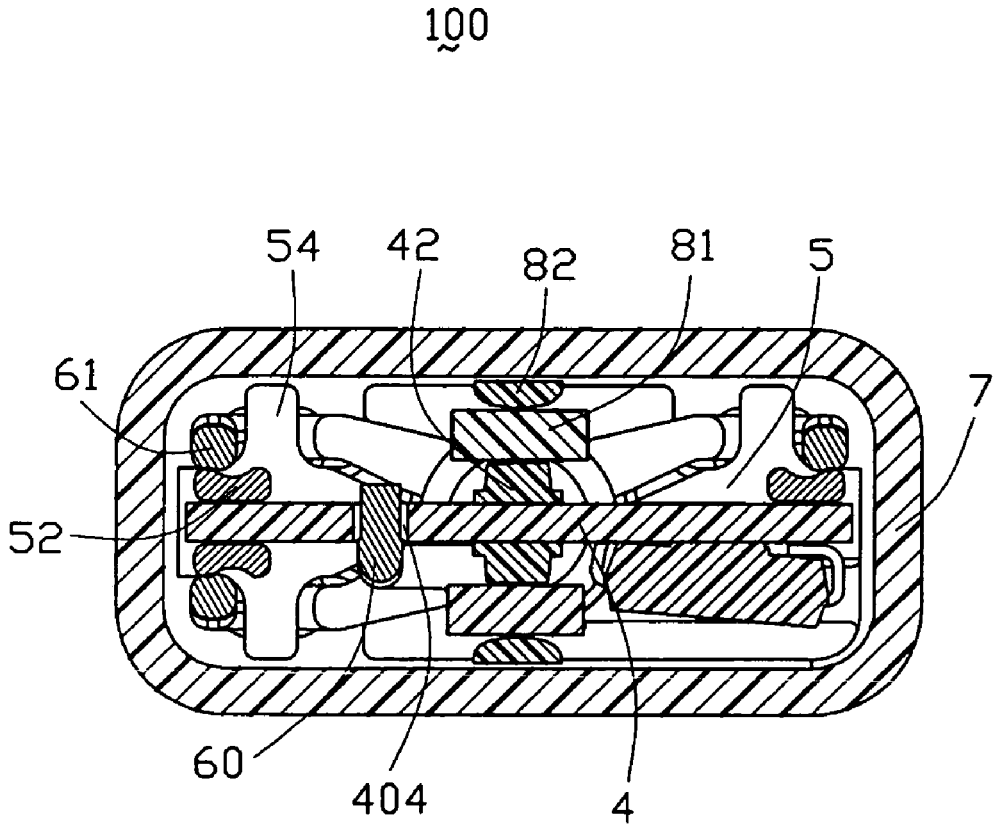
Figure 14:
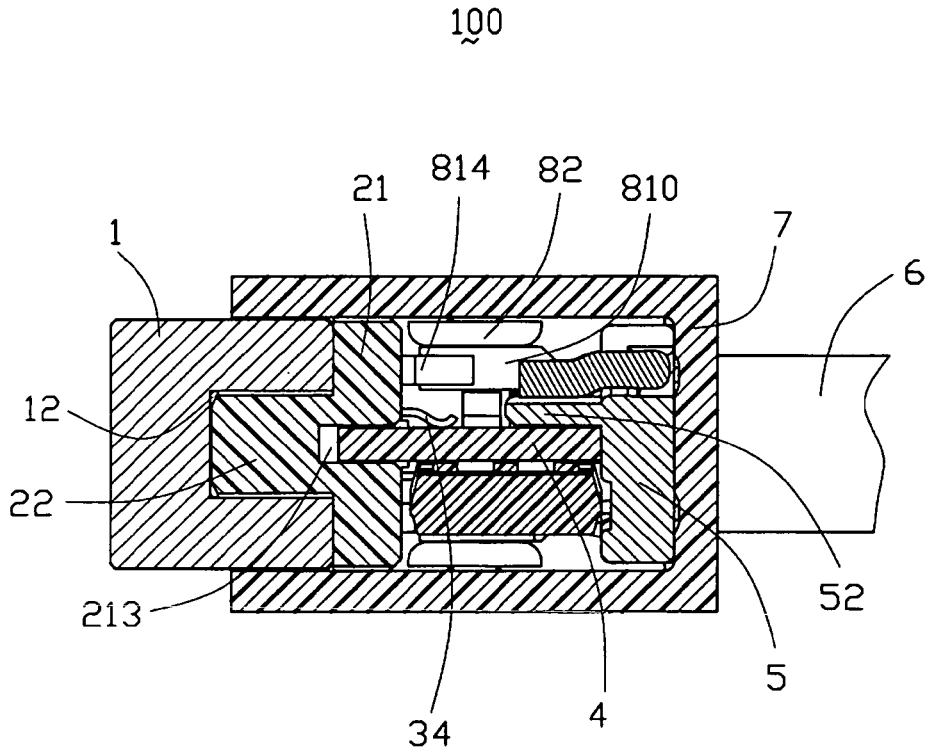

Now referring to FIGS. 1-3 in conjunction with FIGS. 9, 11 and 13, the cable 6 is firstly assembled to the strain relief member 5 then assembled to the circuit board 4 together with the strain relief member 5. The inner conductor 60 protrudes through the through hole 500 of the strain relief member 5, and the three parts of the metal braiding layer 61 firstly wrap to the routing portions 54 with forward portions located in the recess areas 520 of the jointing portions 52. Then, the forward portions of the metal braiding layer 61 are soldered with the jointing portions 52 to form electrical connection with the strain relief member 5. The strain relief member 5 is assembled to a rear end of the circuit board 4 with the jointing portions 52 thereof respectively soldered with opposite upper and lower surfaces of the circuit board 4 and the inner conductor 60 received in the wire-receiving hole 404 of the circuit board 4 and soldered with the circuit board 4. Therefore, the electrical connection between the cable 6 and the circuit board 4 further with the contacts 3 is established. The stuffing member 63 is assembled to the cable 6 from a rear-to-front direction and locates adjacent to front end of the outer jacket 62.

Referring to FIGS. 1-3 in conjunction of FIGS. 7-11, the pair of second light pipes 82 are respectively assembled to the rear cover 7 in a back-to-front manner with the positioning sections 822 respectively located in the pair of receiving holes 74 and the second body sections 820 thereof respectively abutting against opposite inner upper and lower surfaces of the rear cover 7. Then, the rear cover 7 with the pair of second light pipes 82 is engagingly assembled to the housing 2 with the protrusions 700 thereof respectively latching into the cutouts 212 of the housing 2 and the first friction ribs 210 of the housing 2 frictionally engaging with inner periphery of the rear cover 7 to reinforce the engagement therebetween. Thus, a rear portion of the front cover 1, the circuit board 4, the first light pipes 81, the strain relief member 5 and the front end of the cable 6 and the stuffing member 63 are respectively received in the receiving space 70 of the rear cover 7. The cable 6 protrudes through the stepped receiving passage 72 with the stepped-shape stuffing member 63 received in the stepped receiving passage 72 to fill spare space of the receiving passage 72. Meanwhile, the pair of second body sections 820 of the pair of second light pipes 82 respectively align with corresponding first body sections 810 of the first light pipes 81. Thus, the pair of LEDs 42, the pair of first light pipes 81 and the pair of second light pipes 82 are in a stacked relationship in the vertical direction. Once the cable connector assembly 100 mates with the complementary connector normally, the LEDs 42 emit light outwardly, and the light may permeate through the pair of first light pipes 81 then to the second light pipes 82 to indicate the user the normal status of the cable connector assembly 100. Of course, in alternative embodiment, may not adopt the light pipes 81, 82, while, make the rear cover 7 of transparent or semitransparent material to spread the light emitting from LEDs 42 directly for indication. Furthermore, the rear cover 7 may be molded to the above elements to achieve reliable engagement.

A cable connector assembly 200 in accordance with the second embodiment of the present invention is illustrated in FIGS. 17-23. Compared with the cable connector assembly 100, structures of the contacts 3', the strain relief member 5', the cable 6' of the cable connector assembly 200 are different from those of the cable connector assembly 100. In addition, the cable connector assembly 200 further comprises a supporting member 64' for assisting the metal braiding layer 61' of the cable 6' to be soldered with the strain relief member 5' reliably. The cable connector assembly 200 has no conductive elements 34. Now, detail description to the structures different from those of the cable connector assembly 100 will be given hereinafter, and the same structures same as those of the cable connector assembly 100 are omitted here.

Since the cable connector assembly 200 has no conductive elements 34, thus, corresponding first and second rectangular recesses 215, 216 disclosed in the cable connector assembly 100 are omitted in the cable connector assembly 200. Please refer to FIGS. 16-17 and 22, the contacts 3 also comprise a pair of power contacts 31', a pair of ground contacts 32' and a detect contact 33' and have the same arrangement as those of the contacts 3. The difference between the contacts 3', 3 is that each of the power and ground contacts 31', 32' has a tail portion 36' extending beyond the rear surface of the housing 2 to be soldered with corresponding traces of the circuit board 4 directly. The tail portion 36' is cut from the media portion 35 and has an arc shape.

The difference between the cables 6' and 6 exists in the metal braiding layers 61', 61. The metal braiding layer 61' of the cable 6' is shaped into a flat elliptical sheet around the center inner conductor 60. The supporting member 64' having the same shape as that of the metal braiding layer 61' and made from metal material is attached to a rear surface of the metal braiding layer 61' for enhancing the rigidity of the metal braiding layer 61'. The strain relief member 5' also has a rectangular shape with a certain thickness in front-back direction. An elliptical-shape recess 56' is recessed rearwardly from the front face of the strain relief member 5' to receive the supporting member 64' and the metal braiding layer 61' with the front face of the metal braiding layer 61' is substantially coplanar with the front face of the strain relief member 5'. In the present invention, the metal braiding layer 61' of the cable 6', the supporting member 64' and the strain relief member 5' are soldered with one another to form electrical connection. Furthermore, the supporting member 64' is sandwiched between the strain relief member 5' and the metal braiding layer 61'. Three bar-shape jointing portions 52' extend forwardly from the front face of the strain relief members 5'. Two of the jointing portions 52' both extend from one lateral side of the strain relief member 5' and align with each other in a vertical direction with a distance spaced from each other substantially equal to the thickness of the circuit board 4, while the remaining jointing portion 52' extends from the other lateral side of the strain relief member 5' and align with one of the two jointing portions 52' along a longitudinal direction of the strain relief member 5'. Thus, in assembly, the rear edge of the circuit board 4 is sandwiched between the jointing portions 52' and forms electrical connection with the strain relief member 5' by soldering.

Other structures and assembly process of the cable connector assembly 200 same as those of the cable connector assembly 100 are omitted here.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector assembly, comprising:

a housing defining a plurality of passages;

a circuit board assembled to the housing and comprising an LED capable of being actuated to emit light;

a plurality of contacts respectively received in the passages of the housing, the contacts comprising a power contact, a ground contact electrically connecting with the circuit board and a detect contact electrically connecting with the LED of the circuit board;

a cable electrically connecting with the circuit board to form electrical connection with the power contact and the ground contact for power transmission;

a rear cover assembled to the housing to enclose contacts, the circuit board and front end of the cable; and status indicator means aligning with the LED of the circuit board and enclosed by the rear cover to spread the light emitted from the LED outwardly for indicating normal status between the power connector assembly and a complementary connector;

wherein the status indicator means comprises a first light pipe aligning with the LED along a vertical direction perpendicular to a mating direction of the power connector assembly and a second light pipe stacked with the light pipe and the LED along said vertical direction;

wherein the first light pipe is attached to the housing and the second light pipe is attached to the cover.

2. The power connector assembly as claimed in claim 1, wherein the first light pipe comprises a first body section aligning with the LED and a first engaging section extending forwardly from the body section and frictionally engaging with the housing.

3. The power connector assembly as claimed in claim 1, wherein the second light pipe comprises a second body section aligning with the first body section of the first light pipe and a second engaging section frictionally engaging with the cover.

4. The power connector assembly as claimed in claim 3, wherein the cover defines a receiving hole therethrough, and wherein the second engaging section of the second light pipe is post-shape and received in the receiving hole for spreading the light emitted by the LED outwardly.

5. The power connector assembly as claimed in claim 1, further comprising a front cover assembled with the housing and made from conductive material and capable of being attacked by a complementary connector.

6. The power connector assembly as claimed in claim 5, wherein each contact comprises a contacting portion exposed beyond a front surface of the housing and received in the front cover, a media portion engagingly received in the housing, and a tail portion for electrically connecting with the circuit board.

7. The power connector assembly as claimed in claim 1, wherein the contacts are of pogo-type and capable of moving along a mating direction of the power connector assembly.

8. The power connector assembly as claimed in claim 7, further comprising a pair of conductive elements, and wherein each conductive element comprises a connecting portion electrically connecting with corresponding signal and ground contacts, and a tail portion electrically connecting with the circuit board.

9. The power connector assembly as claimed in claim 8, f wherein each conductive element is of L-shape.

10. The power connector assembly as claimed in claim 1, wherein further comprising a strain relief member electrically connecting with the cable and the circuit board.

11. The power connector assembly as claimed in claim 10, wherein the cable comprises an inner conductor directly soldered with the circuit board and a metal braiding layer electrically connecting with the strain relief member.

12. The power connector assembly as claimed in claim 11, the strain relief member comprises a jointing portion soldered with the circuit board, and a routing portion, and wherein the metal braiding layer is firstly wrapped to the routing portion and then soldered with the jointing portion.

13. The power connector assembly as claimed in claim 11, further comprising a supporting member, and wherein the metal braiding layer is shaped into flat sheet and soldered with the supporting member and the strain relief member.

14. A cable connector assembly comprising:

an insulative housing;

a plurality of contacts disposed in the housing;

a printed circuit board located behind the housing and electrically connected to the corresponding contacts;

a cover enclosing said housing and said printed circuit board;

a pair of LEDs mounted upon opposite surfaces of the printed circuit board; and a pair of light pipes seated upon the corresponding LEDs for light transfer; wherein the associated LEDs and light pipes are arranged symmetrically with each other with regard to the printed circuit board, and each of the light pipes essentially extends to said cover of the connector to be visible from an exterior;

wherein the pair of light pipes comprises a first light pipe aligning with the LED along a vertical direction perpendicular to a mating direction of the power connector assembly and a second light pipe stacked with the light pipe and the LED along said vertical direction;

wherein the first light pipe is attached to the housing and the second light pipe is attached to the cover.

15. The assembly as claimed in claim 14, wherein said printed circuit board defines a slot, which extends through the printed circuit board in a vertical direction, in a front edge region thereof to receive a tail of one of said contacts.

* * * * *

UNITED STATES PATENT AND TRADEMARK OFFICE

CERTIFICATE OF CORRECTION

PATENT NO. : 7,247,046 B1
APPLICATION NO. : 11/481267
DATED : July 24, 2007
INVENTOR(S) : Jerry Wu It is certified that error appears in the above-identified patent and that said Letters Patent is hereby corrected as shown below:

In column 8, line 46, in Claim 9, before "wherein" delete "f".

Signed and Sealed this
Twenty-fifth Day of October, 2011

David J. Kappos

David J. Kappos
*Director of the United States Patent and Trademark Office*